US005148643A

United States Patent [19]

Sampson et al.

[11] Patent Number: 5,148,643

[45] Date of Patent: Sep. 22, 1992

[54] SKYLIGHT CONSTRUCTION

[75] Inventors: Robert Sampson, Sanford; Sean Flanigan, Wells, both of Me.

[73] Assignee: Wasco Products, Inc., Sanford, Me.

[21] Appl. No.: 545,516

[22] Filed: Jun. 28, 1990

[51] Int. Cl.[5] ..... E04B 7/18

[52] U.S. Cl. ..... 52/200; 52/72; 52/403; 49/485; 49/495

[58] Field of Search ..... 52/200, 72, 403; 49/325, 402, 485, 504

[56] References Cited

U.S. PATENT DOCUMENTS

| | | | |
|---|---|---|---|
| 4,455,799 | 6/1984 | Jentoft et al. | 52/200 |
| 4,466,221 | 8/1984 | Couture | 52/200 |
| 4,570,393 | 2/1986 | Hinter | 52/72 |
| 4,703,592 | 11/1987 | Sampson et al. | 52/200 |
| 4,928,445 | 5/1990 | Sampson et al. | 52/200 X |
| 4,930,275 | 6/1990 | Verby et al. | 52/200 |
| 4,987,705 | 1/1991 | Sampson et al. | 52/72 |

FOREIGN PATENT DOCUMENTS

| | | | |
|---|---|---|---|
| 215231 | 3/1987 | European Pat. Off. | 52/200 |

*Primary Examiner*—David A. Scherbel
*Assistant Examiner*—Kien Nguyen
*Attorney, Agent, or Firm*—Wolf, Greenfield & Sacks

[57] ABSTRACT

A skylight construction having a wooden base frame extending about a roof opening and secured to the roof. The skylight construction is illustrated as a step flash skylight including a rigid plastic curb frame having a base frame and overlying sash frame. A retainer is provided for supporting glazing plates over the sash frame. The PVC base frame is firmly secured to the wooden base frame by interlocking with the wooden base frame. Hinge members interconnect a base frame and sash frame of the rigid curb frame providing water tight sealing between the hinge members.

18 Claims, 6 Drawing Sheets

SKYLIGHT CONSTRUCTION

BACKGROUND OF THE INVENTION

1. Field of the Invention

The present invention relates in general to an improved skylight construction and is concerned, more particularly, with an improved skylight construction employing a rigid plastic curb frame providing simplified manufacture and improved temperature resistant and weathering properties. Even more particularly, the present invention relates to improvements in skylight features in particular applicable to step flash skylights.

2. Objects of the Invention

It is a general object of the present invention to provide improvements to skylights and, in particular, skylights employing a rigid plastic curb frame.

Another object of the present invention is to provide an improved skylight construction which is in particular applicable to a step flash skylight.

A further object of the present invention is to provide an improved skylight construction used with a wood base frame, providing an improved interlocking arrangement for engagement between the rigid plastic curb frame and the wooden base frame so as to facilitate convenient assembly of the curb frame to the wood base frame.

Another object of the present invention is to provide an improved step flash skylight construction that is of simplified construction, can be manufactured relatively easily and at a relatively low cost and that is simple to install.

Still another object of the present invention is to provide an improved skylight construction that preferably employs a PVC curb frame constructed from an extrusion employing high performance co extruded weather stripping, moisture and condensation protection and control, and integral counterflashing.

Another object of the present invention is to provide an improved skylight construction having improved gasketing and flashing features.

A further object of the present invention is to provide an improved skylight construction having, in particular, an improved hinging arrangement that provides, not only for hinging between skylight sections, but also liquid tightness at the different sections of the hinge so as to prevent water penetration through the hinge.

SUMMARY OF THE INVENTION

To accomplish the foregoing and other objects, features and advantages of the invention, there is provided a skylight construction adapted to be fitted into an opening in a building such as either a commercial building or a residential building. A rigid plastic curb frame means is provided and is firmly secured about the building opening. Transparent or translucent covering means are provided and retained on the rigid plastic curb frame means. In accordance with a preferred embodiment of the present invention, the skylight construction is of step flash skylight type and the base frame is preferably a stepped wooden base frame upon which the rigid plastic curb frame means is secured. The rigid plastic curb frame means comprises a plastic base frame that is stationary and an overlying, removeable sash frame. The sash frame supports glazing plates or the like. Hinge means are provided for engaging the base and sash frames. The hinge means comprises separate plastic hinge members that are secured to the respective frames. The hinge members are adapted to interlock in a close position of the frames to provide a water tight seal at the hinge members and are engagable in a releasable manner in an open position of the frames so that the frames can be separated from each other for such purposes as installation or replacement of the glazing.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Reference is now made to the drawings for an illustration of constructions of the present invention. FIGS. 1–7 illustrate one construction for the skylight. FIGS. 8–11 illustrate a preferred hinge construction.

Figure 1:
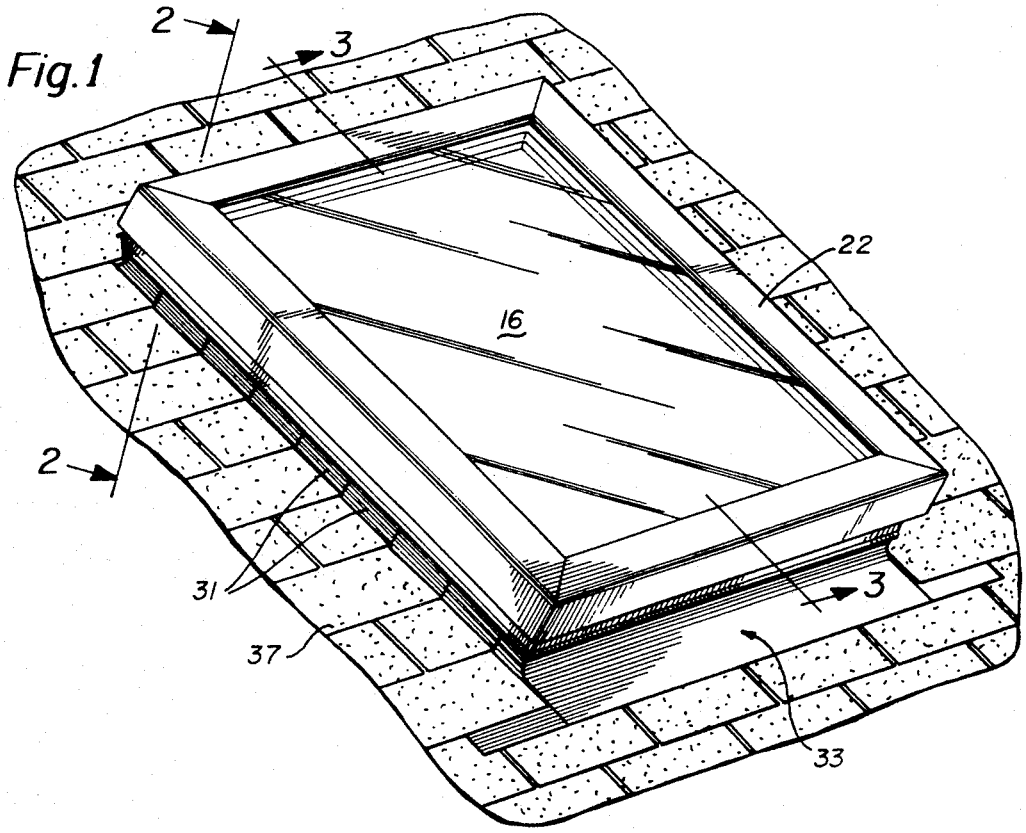
FIG. 1 is a prospective view of the skylight construction of the present invention as secured in a roof.
Figure 2:
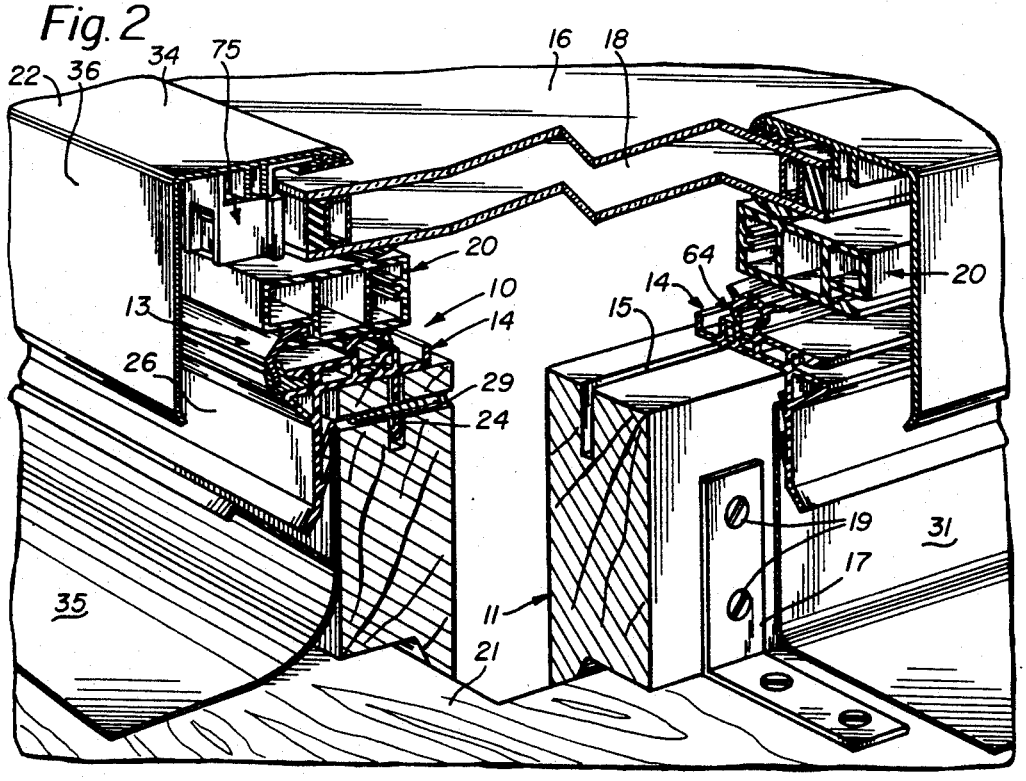
FIG. 2 is a cross-sectional view taken along line 2—2 of FIG. 1 showing further details of the skylight construction illustrated, in particular, in embodiment of the skylight construction in the form of a step flash skylight.
Figure 3:
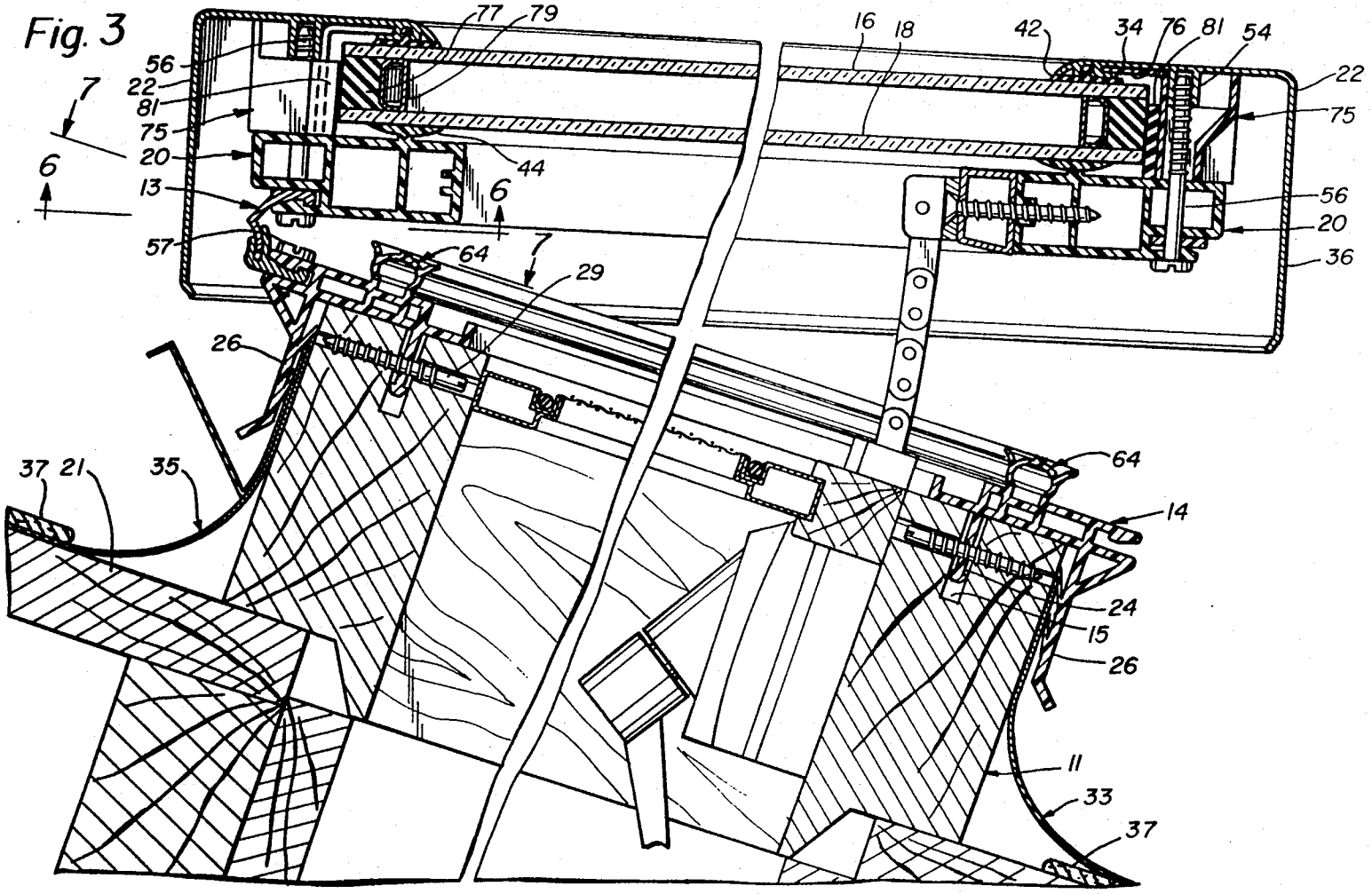
FIG. 3 is a cross-sectional view through the skylight construction of FIGS. 1 and 2 as taken along line 3—of FIG. 1.

It is noted that in the embodiment of the invention as illustrated in, for example, FIGS. 1–3, the skylight is of a substantially flat construction employing glazing panels. However, in alternate constructions, a domed type skylight may also be employed. The skylight is adapted to span an opening which is generally of square or rectangular shape and the opening may be defined by upright walls or by headers which are part of the roof construction. Refer in particular to FIG. 3 for an illustration of part of the roof construction.

The skylight described herein is characterized by improved energy performance; thermal air and weather tightness; simplicity of installation; good weathering properties; and enhanced durability.

In the embodiments disclosed herein, it is noted that the skylight is illustrated as preferably being of step flash construction. Illustrated herein are various forms of hinge construction. These hinge constructions have a dual purpose use of providing both hinging while also functioning as an impenetratable barrier to water rushing onto the skylight, particularly at the top thereof. These hinge constructions eliminate the necessity for separate water diverter flashing components. The hinge constructions illustrated herein also permit sash removal during installation.

The skylight construction shown herein includes a pair of glazing panels 16 and 18, a rigid plastic curb frame 10 for support of the glazing panels and a wooden base frame 11. The rigid PVC curb frame 10 in the embodiment illustrated in FIGS. 1-3, is comprised of two separate sections that are hinged as illustrated at 13 in FIG. 3. These two separate sections include a base frame 14 that is adapted to interlock with the wooden base 11, and an overlying sash frame 20. Refer in particular to the exploded cross sectional view of FIG. 4 for an illustration of the specific cross-section configuration of the base frame 14 and the overlying sash frame 20.

The two frames 14 and 20 are constructed of a rigid PVC material and these frames are separately constructed each of separate co extruded pieces formed together in a frame construction.

Figure 4:
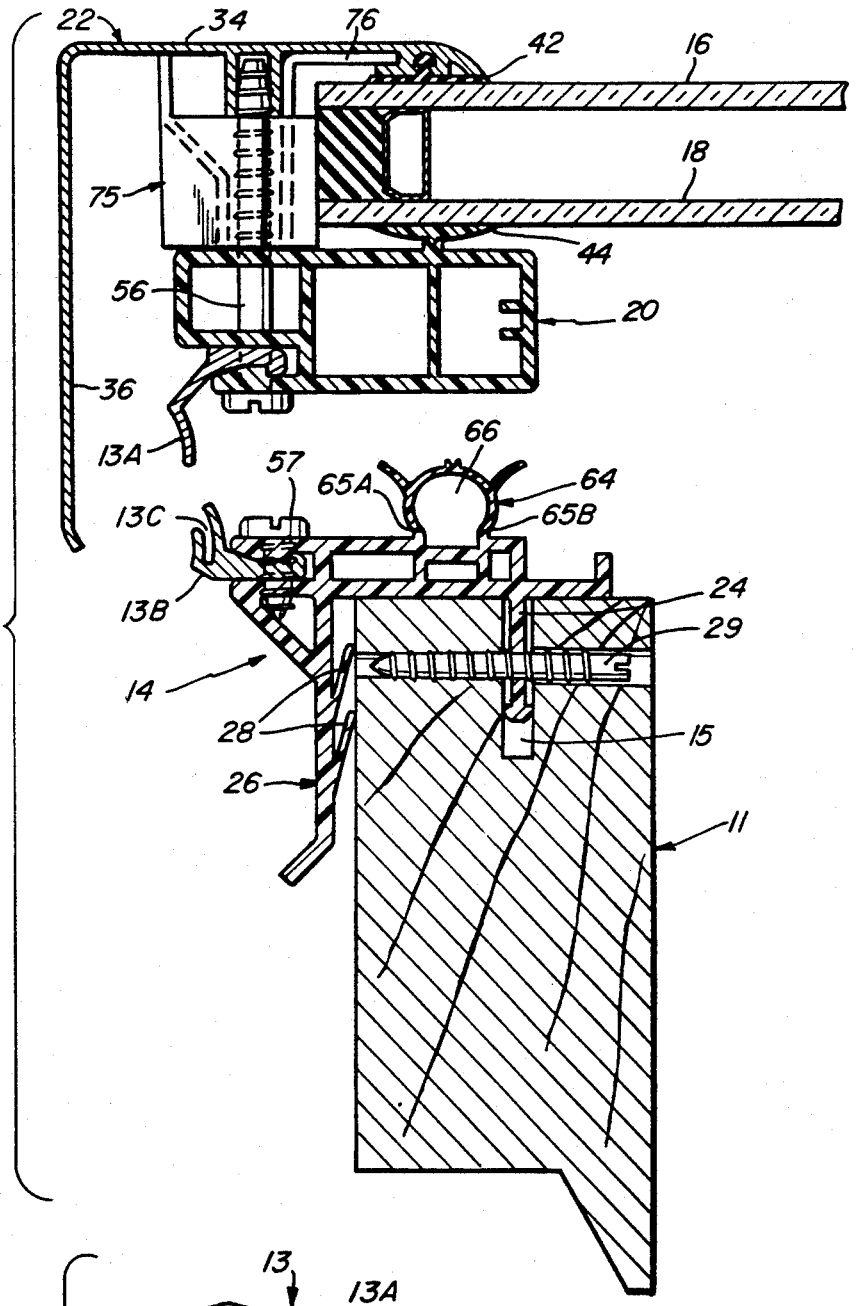
FIG. 4 is an exploded cross-sectional view showing further details of components of the skylight construction.
Figure 5:
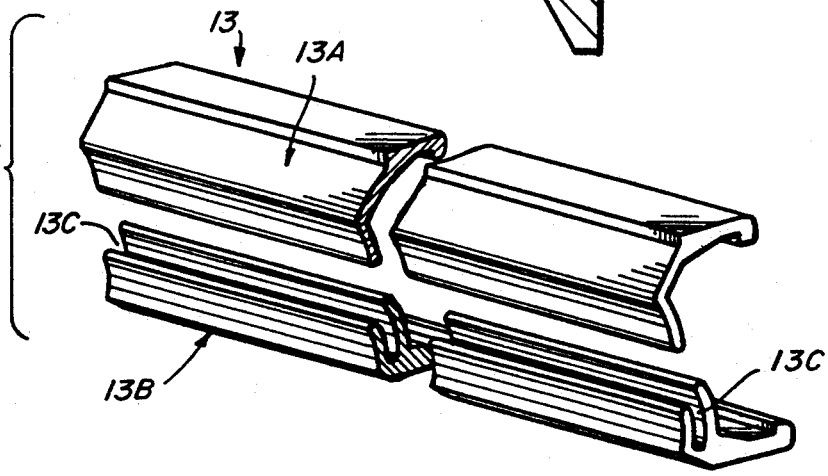
FIG. 5 is a prospective view illustrating one embodiment of the hinge construction of the present invention.
Figure 6:
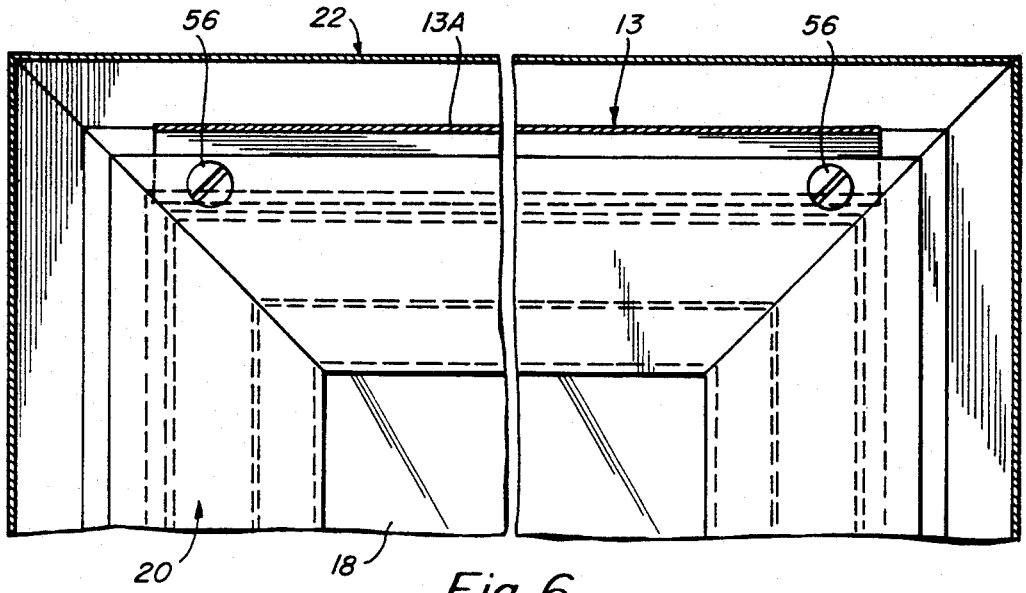
FIG. 6 is a fragmentary cross-sectional view as taken along line 6—6 of FIG. 3.
Figure 7:
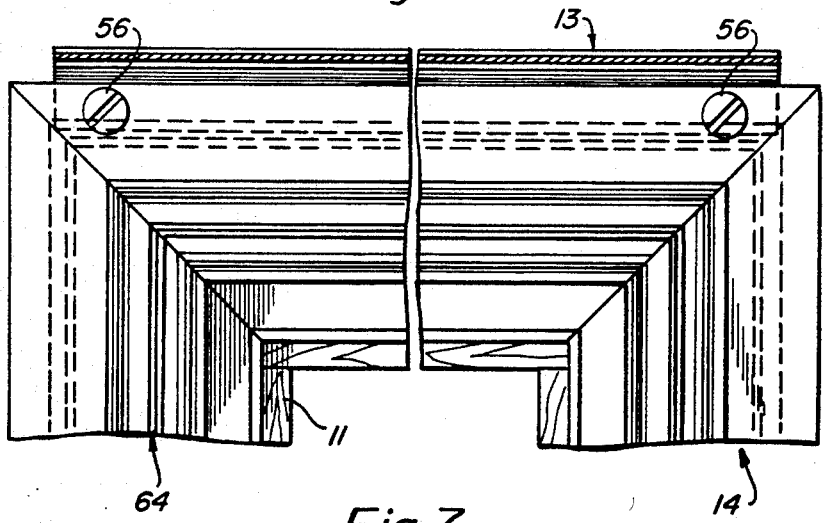
FIG. 7 is a fragmentary cross sectional view as taken along line 7—7 of FIG. 3.

The drawings also illustrate the retainer 22 which is disposed at the very top of the skylight and which is used for securing the glazing panels 16 and 18 to the sash frame 20. The retainer 22 is preferably constructed of a lightweight metal material such as aluminum and has the general L-shaped cross section such as illustrated in FIGS. 3 and 4.

Each of the frames 14 and 20 is constructed by a co-extrusion process in which one or more flexible gaskets are co extruded with the rigid main part of the frame. For example, the frame 20 carries a cupped gasket 44 against which the glazing panel 18 rests. Similarly, the frame 14 carries a flexible sealing gasket 64. The gasket 64 is adapted for gasket support between the frames 14 and 20. In this regard, FIG. 2 illustrates the gasket 64 in its at least partially compressed state sealing between the frames 14 and 20.

The gasket 64 illustrated herein is of similar general construction to the gasket illustrated in our related application Ser. No. 07/283,803 filed Dec. 13, 1988, which application is hereby incorporated by reference herein.

The gasket 64 illustrated in this application does differ somewhat from the gasket illustrated in the aforementioned U.S. Ser. No. 07/283,803 in that it has two separate attachment points at 64A and 65B to the frame 14. The gasket 64 provides multi point gasketing for locking out air and moisture while providing superior energy efficiency and weather tightness. The gasket 64 is co extruded with the frame 14 and is thus continuously bonded to the frame for permanent protection.

The gasket 64 with its two point attachment at 65A and 65B, as noted in, for example, FIG. 4, is hollow and generally of tubular construction. It thus provides a space 66 for any weld upset so that it can flow into the space and thus not interfere with the function of the gasket, particularly when it is moved to its compressed stated. In this regard, as noted in FIG. 4, there is actually a recess at 66.

In connection with both the frames 14 and 20, as indicated previously, these are constructed of separate co extruded pieces that are constructed into a closed frame. At the corner miters, such as illustrated in, for example, FIG. 6, both the rigid and flexible parts of the frames are joined by a technique such as a heat platen sealing technique. This technique commonly joins the rigid frame sections at the corner miters for the same time joining the gaskets for providing a continuous seal above the entire skylight curb frame construction.

Now, with respect to the gasket 64, there is a multi point contact with the glazing. This is provided by the sealing lip 82 along with the oppositely disposed ears 67A and 67B. This particular construction with the use of a substantially open and tubular gasket configuration provides improved weather and air tightness. Furthermore, there is a reactionary mechanical action that occurs when the gasket is compressed so as to enhance tightness of the gasket between the elements that are being compressed against the gasket.

Reference has been made herein before to the wooden base 11. In this regard, refer to FIGS. 2 and 3 which show the base 11 in place about the opening. The base 11 may be provided with mortise and tenon corner joints. This provides a rugged interlocking wood joint construction that provides superior strength. Also, this provides a wood curb interior finish that provides for a very asthetic appearance on the inside of the skylight.

To enable the curb frame 10 to be secured to the wooden base 11, the wooden base 11 is provided with a longitudinal slot 15 that is dimensioned to properly receive the downwardly depending leg 24 of the base frame 14.

The wooden base 11 is secured in position about the opening by means of a series of angle brackets 17. The angle brackets 17 are secured by means of screws 19 as illustrated in FIG. 2. This arrangement secures the wooden frame 11 in proper position as illustrated in FIG. 2 and with respect to the roof decking 21.

In accordance with the present invention, the skylight construction also employs a unique step flashing arrangement. The flashing material itself is a superior polyester-based dark bronze coating provided on a rule formed aluminum. This is designed for leak proof installation. The arrangement provides for an uncomplicated assembly and disassembly saving time and money. The flashing components are preferably pre fabricated. As illustrated in FIGS. 2 and 3, the flashing includes side step flashing pieces 31, a sill flashing piece 33 and a head flashing piece 35.

As far as the sequence of installation is concerned, the sill flashing piece 33 is installed first followed by the successive installation of side flashing pieces 31. Shingles 37 are laid over these flashing pieces. In this connection, FIG. 4 also illustrates the curb frame and, in particular, the base frame 14 positioned over the wooden frame 11.

In the sequence of installation, after the side sill pieces are installed, then the head flashing piece 35 is installed at the top end of the skylight. The next step in the sequence is to install the base frame 14 to the wooden bas 11.

The base frame 14 has, in addition to the leg 24, also a counterflashing leg 26 that depends downwardly from the main portion of the frame 14. The leg 26 carries co extruded and integral weather strips or flashing seals 28. FIG. 4 shows the seals providing their sealing and gasketing function urged against one of the flashing pieces.

FIG. 4 illustrates the base frame 14 in a position installed in the wooden base 11. For this purpose, the leg 24 is inserted in the slot 15 of the base 11 and a series of securing screws 29 firmly lock the base frame 14 to the wooden base 11. For this purpose, at least the wooden base 11 may be pre drilled with holes. The leg 24 may also, at least in one embodiment, be provided with holes that will align with the holes 25. Alternatively, the screw 29 may be adapted to simply drill through the leg 24.

The skylight glazing plates 16 and 18 are supported over the support frame 20 by means of the retainer 22. The plates 16 and 18 are supported by a glazing frame 79. On the outer periphery of the frame 79 between the plates 16 and 18 there is a cupped sealing gasket 77. The cupped sealing gasket 77 may be of a pre molded butyl material. As illustrated in, for example, FIG. 3, the frame 79 may be comprised of a metal spacer with an outer seal comprising a chemically curable two part polysulfied.

The lower glazing plate 18 rests upon the cupped sealing gasket 77 which is co-extruded with the support frame 20. In FIG. 3, the gasket 44 is shown in its compressed position. The sash frame 20 also includes means defining a channel for receiving a securing bolt 56. The bolt 56 at its end, such as illustrated in FIG. 3, is received in an internally threaded flange 54 of the retainer 22. A series of bolts 56 are used spacedly disposed about the frame 20 for securing the glazing in place. A plurality of these securing bolts or screws are employed for securing the retainer 22 over the glazing plates 16 and 18.

As also illustrated in FIGS. 2 and 3 herein, there is provided a glazing cushioning member 75 that forms a cushioning for the edges of the glazing plates to prevent damage thereto, as well as to facilitate positioning thereof. For further details of the glazing cushioning member 75, reference may be made to our co-pending application Ser. No. 07/283,797 which was filed on Dec. 13, 1988, which is hereby incorporated by reference herein.

The retainer 22 has a top leg 34 and a side leg 36. The retainer 22 is generally of L-shaped construction. The top leg 34 of the retainer 22 is adapted to receive a gasket 42 that is relatively flat and that is interlocked with the very free end of the leg 34. The gasket 42 may be constructed of a pre-molded butyl material and is adapted to engage with and securely hold the top of the glazing plates, contacting the plate 16 as illustrated in FIG. 3. The top leg 34 also has a slot defined therein for receiving a leg 76 of the cushioning member 75.

In FIG. 3, the cushioning member 75 is illustrated. It may be constructed either of a lightweight metal material or a hard plastic and supports therefrom a somewhat more resilient and flexible cushioning piece 81. It is the piece 81 that rests directly against the glazing plates as illustrated in FIG. 3. FIG. 3 also illustrates in the completed cross-section part thereof the bolt 56 extending through the frame 20, through the glazing cushioning member 75 and into the threaded flange 54. This arrangement positions the cushioning piece 81 adjacent the edge of the glazing plates as illustrated.

The bolt 56, such as illustrated in FIG. 3, also is used for securing a part of the hinge 13. In this regard, in the particular embodiment of FIG. 3, the hinge 13 is comprised of hinge parts 13A and 13B. The hinge part 13B has a recess 13C for receiving the leg of the hinge part 13A. FIG. 4 illustrates the hinge members separated. FIG. 3 illustrates the hinge members engaged. The hinge member 13B is secured to the lower base frame 14 by means of a further series of securing bolts 57. The hinge parts 13A and 13B may be constructed of a PVC material that is somewhat more flexible than the rigid PVC materials that comprise the frames 14 and 20.

Reference is now made to FIGS. 8–11 for a preferred embodiment of the hinge construction that interconnects the base frame 14 and the sash frame 20. In FIGS. 8–11, the same reference characters are employed as previously used in connection with the previous embodiment such as the one illustrated in FIGS. 1–7 herein. Accordingly, the skylight construction includes a wooden base 11, a PVC base frame 14, a PVC sash frame 20, a retainer 22, and glazing plates 16 and 18.

Figure 8:
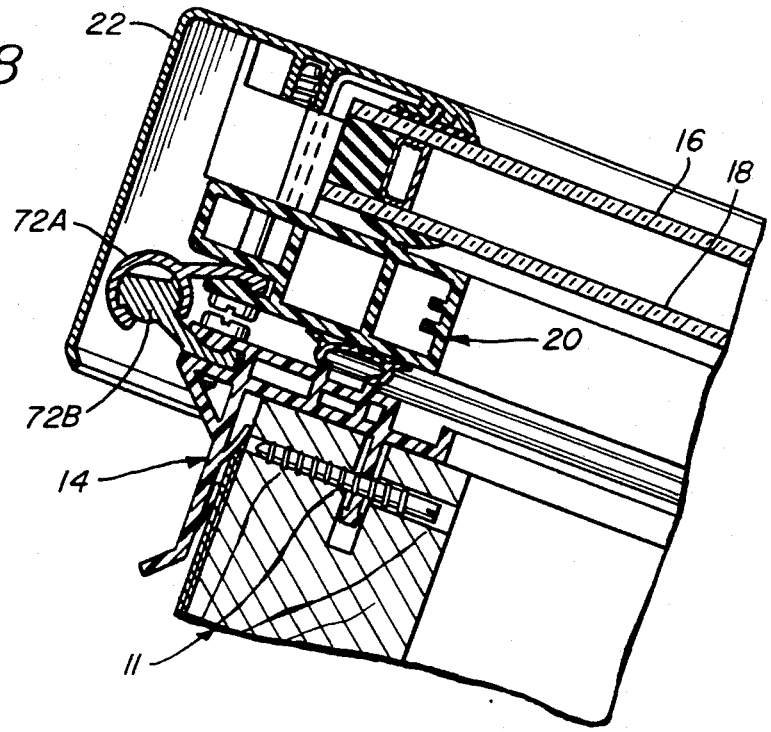
FIG. 8 is a cross-sectional view of an alternate preferred construction for the hinge member of the skylight.

The preferred hinge construction includes hinge members 72A and 72B. The member 72A is constructed in a generally C-shape having a recess 72C for receiving the member 72B. The member 72B is of partially circular shape constructed with at least one flat segment 73. When the skylight is closed, these members interlock in a positive fashion as illustrated in FIG. 8 with segments of the hinge members engaging in a positive tight interlocking. When the skylight is opened as in FIG. 9, then the hinge members may be disengaged from each other. In this way, the sash frame 20 can be removed for installation purposes and can later be re-engaged with the base frame of the skylight. It is noted that each of the frame members 72A and 72B have legs for support thereof from the respective frames and for securing by the respective securing bolts 56 and 57.

Figure 9:
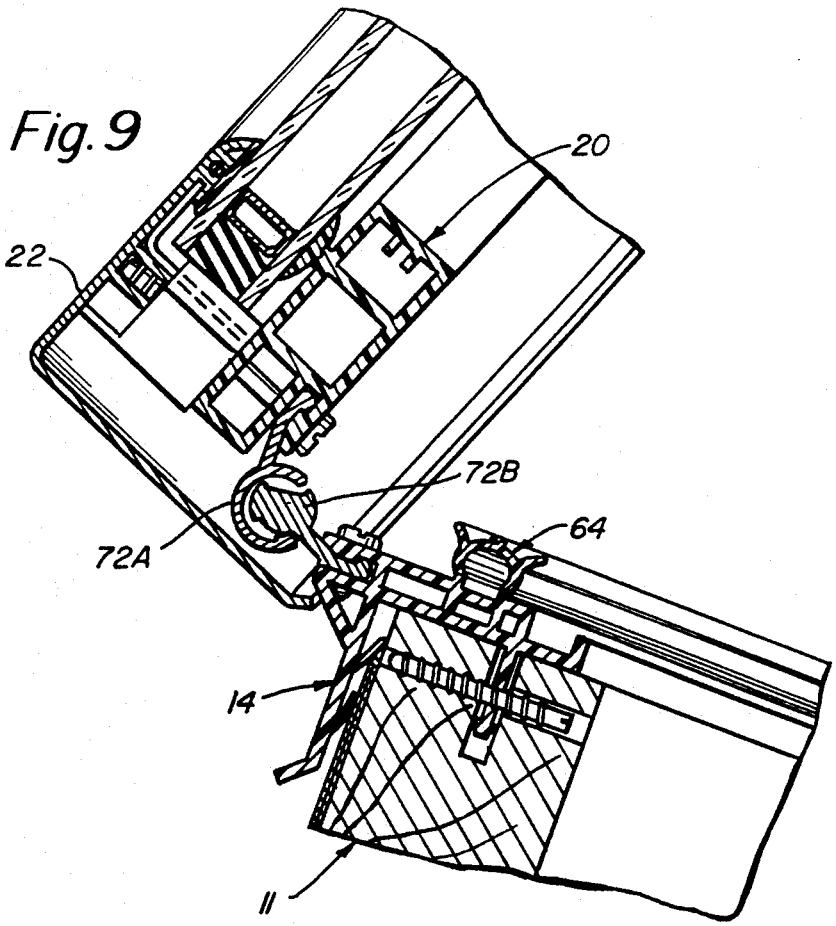
FIG. 9 is a cross-sectional view of the hinge of FIG. 8 showing the skylight in an open position.
Figure 10:
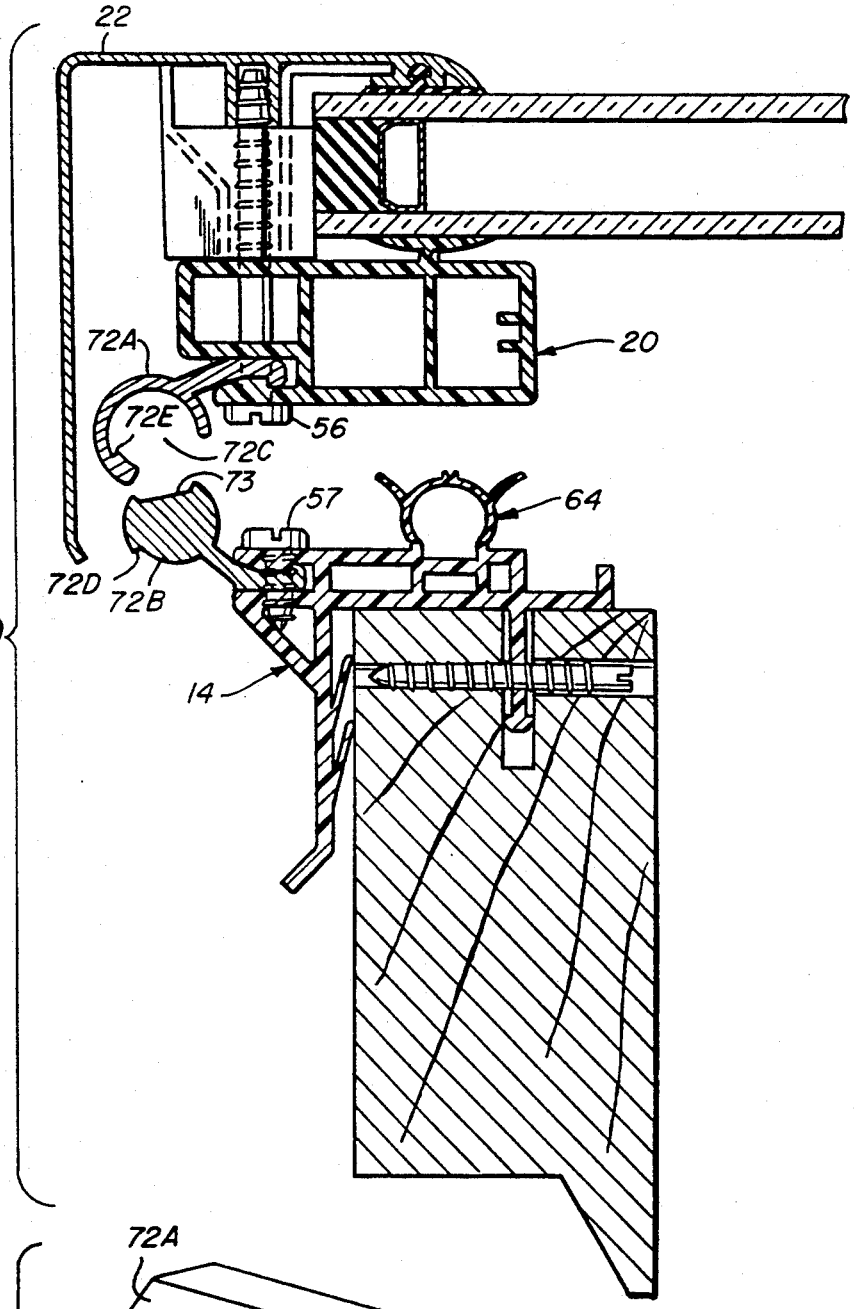
FIG. 10 is an exploded cross sectional view showing the preferred hinge arrangement of FIGS. 8 and 9.
Figure 11:
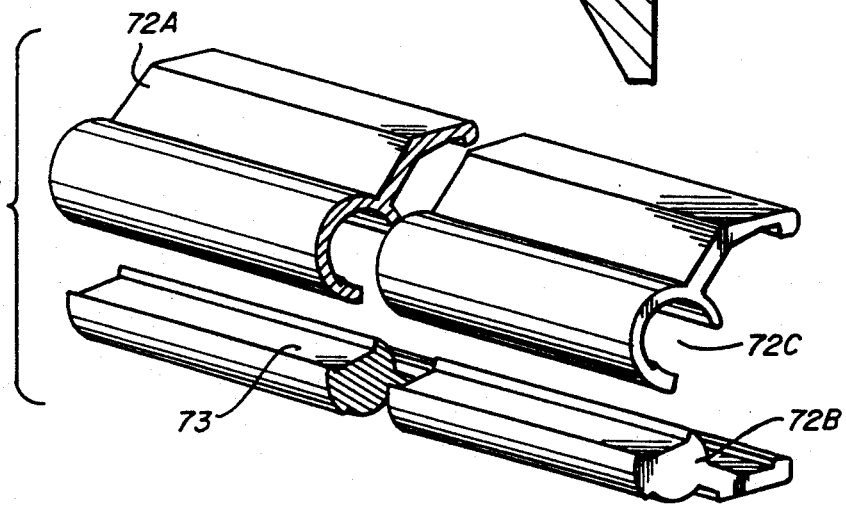
FIG. 11 is a prospective view of the hinge members used in FIGS. 8–10.

With further reference to FIGS. 8–11, it is noted that the member 72B is constructed to have a shoulder 72D that is adapted to lock against shoulder 72E of member 72A. These shoulders are shown in water tight interlocking relationship in FIG. 8. When the skylight is opened, as illustrated in FIG. 9, the general dimensions of the member 72B permitted to be withdrawn through the opening formed by the member 72C. This is clearly illustrated in FIG. 9 wherein it is noted that the height of the member 72B is less than the opening so that the members can be readily disengaged.

Having now described a limited number of embodiments of the present invention, it should be apparent to those skilled in the art that numerous other embodiments and modifications thereof are contemplated as falling within the scope of the present invention as defined by the appended claims.

What is claimed is:

1. A skylight construction for an opening in a building or the like comprising: a rigid plastic curb frame means comprising, a plastic base frame and a sash frame means for firmly securing said rigid plastic curb frame means about said opening, transparent or translucent covering means, means for retaining the covering means on the rigid plastic curb frame means, hinge means comprising separate plastic base frame hinge member and sash frame hinge member, means connecting the hinge members to respective base and sash frames, said hinge members interlocking along an axis in a closed position of the frames to provide a water tight seal at said hinge members, said sash frame hinge member releasable from said base frame hinge member in a non-axial direction and lateral to the axis of the hinge members but only in at least a partially open position of the frames.

2. A skylight construction as set forth in claim 1 including a gasket extending from the base frame and disposed between the base frame and the sash frame.

3. A skylight construction as set forth in claim 1 wherein said hinge means has its hinge members locked together in the closed position.

4. A skylight construction as set forth in claim 1 wherein said covering means includes at least one plate means.

5. A skylight construction as set forth in claim 4 wherein said covering means includes a pair of glazing plates.

6. A skylight construction as set forth in claim 1 wherein said retaining means includes a retaining having one leg extending downwardly towards the base frame and another leg extending inwardly to contact the edge of the covering means.

7. A skylight construction as set forth in claim 1 including a cupped gasket carried by the sash frame means and upon which the covering means rests.

8. A skylight construction as set forth in claim 1 including a wooden base and means for positively interlocking the base frame with the wooden base including a securing bolt or screw.

9. A skylight construction as set forth in claim 8 wherein said base frame having a downwardly depending leg adapted to be accommodated in a slot extending longitudinally of said wooden base.

10. A skylight construction as set forth in claim 9 wherein said wooden base has the slot therein extending peripherally thereabout, said depending leg of said base frame also extending peripherally thereabout.

11. A skylight construction as set forth in claim 10 wherein said securing bolt or screw is adapted to extend through the wooden base, and through the downwardly depending leg to secure the rigid plastic base frame to the wooden base.

12. A skylight construction for an opening in a building or the like comprising: a rigid plastic curb frame means including fixed movable frame members, means for firmly securing said fixed frame about the opening, transparent or translucent covering means, means for retaining the covering means on the movable frame, hinge means comprising separate plastic base frame hinge member and sash frame hinge member, means connecting the hinge members to respective base and sash frames, said hinge members adapted to have separate closed and open positions, the hinge members interlocking along an axis in the closed position of the frames to provide a water tight seal at said hinge members, said sash frame hinge member releasable from said base frame hinge member in a non-axial direction and lateral to the axis of the hinge members but only in at least a partially open position of the frames.

13. A skylight construction as set forth in claim 12 wherein said base frame has a peripherally disposed counter-flashing piece extending downwardly therefrom and disposed outwardly of the frame means, said counter-flashing piece having flashing seal means including at least a pair of spacedly disposed sealing members.

14. A skylight construction as set forth in claim 13 wherein the flashing seal means of the counterflashing piece extends in a direction toward said downwardly depending leg and are positioned therefrom a distance so that the flashing seal means are compressed when the rigid plastic base frame is secured with the wooden base frame.

15. A skylight construction for an opening in a building or the like comprising: a rigid plastic curb frame means comprising, a plastic base frame and a sash frame means for firmly securing said rigid plastic curb frame means about said opening, transparent or translucent covering means, means for retaining the covering means on the rigid plastic curb frame means, hinge means comprising separate plastic hinge members, means connecting the hinge members to respective frames along a hinge axis, one of said hinge members being a female hinge member and the other said hinge member being a male hinge member, said female hinge member having an opening for releasably receiving the male hinge member, said male hinge member including means for interlocking in a non-releasable manner with the female hinge member when the frames are closed, and said female hinge member dimensioned to be releasable from said male hinge member by separation therefrom in a direction lateral to the axis of said hinge means through said opening of said female hinge member when the frames are open.

16. A skylight construction as set forth in claim 15 or claim 22 wherein the hinge member associated with the moveable frame comprises means defining a partially circular recess.

17. A skylight construction as set forth in claim 16 wherein the hinge member associated with the fixed frame comprises a partially circular member.

18. A skylight construction for an opening in a building or the like comprising: a rigid plastic curb frame means including fixed and movable frame members, means for firmly securing said fixed frame about the opening, transparent or translucent covering means, means for retaining the covering means on the movable frame, hinge means comprising separate plastic hinge members, means securing the hinge members to respective frames along a hinge axis, the hinge members interlocking in the closed position of the frames to provide a water tight seal at said members, one of said hinge members being a female hinge member and the other said hinge member being a male hinge member, said female hinge member having an opening for releasably receiving the male hinge member, said male hinge member including means for interlocking in a non-releasable manner with the female hinge member when the frames are closed, and said female hinge member dimensioned to be releasable from said male hinge member by separation therefrom in a direction lateral to the axis of said hinge means through said opening of said female hinge member when the frames are open.

* * * * *